US006477732B1

(12) United States Patent
Cline et al.

(10) Patent No.: US 6,477,732 B1
(45) Date of Patent: Nov. 12, 2002

(54) FOLDING BRISTLE HAIRBRUSH

(76) Inventors: Kevin W. Cline, 2504 Arbor Trail, Colleyville, TX (US) 76034; John A. McCurdy, 400 Lloyd Cir., Colleyville, TX (US) 76034

( * ) Notice: Subject to any disclaimer, the term of this patent is extended or adjusted under 35 U.S.C. 154(b) by 0 days.

(21) Appl. No.: 09/549,293

(22) Filed: Apr. 14, 2000

(51) Int. Cl.[7] ..... A46B 7/02; A45D 24/06

(52) U.S. Cl. ..... 15/185; 15/203; 132/121

(58) Field of Search ..... 15/203, 185, 201, 15/184; 132/121

(56) References Cited

U.S. PATENT DOCUMENTS

| | | | | | |
|---|---|---|---|---|---|
| 696,798 | A | * | 4/1902 | Chambers | 15/203 |
| 1,565,228 | A | * | 12/1925 | Johnson | 15/203 |
| 1,592,510 | A | * | 7/1926 | Toepperwein | 15/203 |
| 2,507,340 | A | * | 5/1950 | La Veites et al. | 15/203 |
| 2,604,649 | A | * | 7/1952 | Stephenson et al. | 15/203 |
| 3,086,236 | A | * | 4/1963 | Anonsen | 15/203 |
| 3,977,420 | A | | 8/1976 | Yalof | |
| 4,027,768 | A | | 6/1977 | Riessen | |
| 4,121,314 | A | | 10/1978 | Nathe | |
| 4,137,596 | A | | 2/1979 | Carlson et al. | |
| 4,214,340 | A | | 7/1980 | Youngberg et al. | |
| 4,321,723 | A | | 3/1982 | Kortick | |
| 4,494,269 | A | | 1/1985 | Makabe | |
| 4,498,211 | A | | 2/1985 | Bottolfson | |
| 4,507,818 | A | | 4/1985 | Perdiz | |
| 4,847,937 | A | | 7/1989 | Gorski | |
| 4,987,633 | A | * | 1/1991 | Heneveld | 15/185 |
| 5,185,902 | A | | 2/1993 | Fong | |
| 5,335,390 | A | * | 8/1994 | Chen | 15/203 |
| 5,335,590 | A | | 8/1994 | Crump, III et al. | |
| 5,815,877 | A | | 10/1998 | Heneveld | |

FOREIGN PATENT DOCUMENTS

| | | | | |
|---|---|---|---|---|
| DE | 155564 | * | 6/1905 | 15/203 |
| DE | 171666 | * | 12/1934 | 15/203 |
| FR | 793548 | * | 11/1935 | 15/203 |

* cited by examiner

*Primary Examiner*—Gary K. Graham
(74) *Attorney, Agent, or Firm*—Matthew S. Anderson

(57) ABSTRACT

An ultra-thin folding bristle hairbrush, capable of being operated with one hand, suitable for back-pocket storage. A base enclosure comprising a plurality of spaced transverse bristle bars, each bristle bar pivotally mounted within the base enclosure. At one end, the base enclosure is pivotally attached to a handle member. A kinematical linkage assembly adjoins the handle with the plurality of bristle bars whereby the opening and closing motion of the handle results in a synchronized articulation of the bristles from a stowed, generally horizontal, position, to a generally vertical position of use. The linkage lends itself to contouring the base enclosure and handle for ergonomic consideration such as back-pocket storage. The handle can also operate as a cover element. A unique one-handed "switchblade" action can be employed to flip open the brush, installing the bristles into their position of use.

7 Claims, 10 Drawing Sheets

FOLDING BRISTLE HAIRBRUSH

BACKGROUND OF THE INVENTION

1. Technical Field

The present invention generally relates to personal grooming devices and in particular to hairbrushes. Still more particularly, the present invention relates to an improved hairbrush with folding bristles for compact storage when not in use.

2. Description of the Related Art

There have been numerous attempts to manufacture a thin, inexpensive, reliable, and foldable hairbrush. With current hair styles, both women and men are using the contemporary plastic bristle brushes to groom and style their hair. Women typically utilize handbags to carry hairbrushes. Men, however, when away from home are typically forced to rely on a pocket comb to groom their hair. The reason for this is that typical hairbrushes are much too bulky to be easily carries in a man s pockets, and because a truly functional, reliable, extremely low profile, and foldable hairbrush has yet to be manufactured where the brush can be comfortably stored in a trouser pocket.

To address this problem, several attempts have been made to introduce a hairbrush that can be folded or manipulated into a compact package to be easily stored or carried. Many of these prior art solutions rely on a sliding action to retract and extend a multiplicity of bristles into and out of a base member. Generally, this action requires the use of two hands; one hand is needed to support the brush, while the other hand is used to operate the sliding mechanism. The bristles are more often than not extended and retracted through various shape apertures, which can become clogged with debris such as dust, lint, dirt, hair, and hair gel. The sliding action also creates friction, which is detrimental to a smooth and repeatable operation. Several of these prior-art solutions, and the disadvantages of each, are discussed below. It will be easily seen that none of the prior art designs provide an acceptable solution.

U.S. Pat. No. 5,815,877 to Heneveld (Oct. 6, 1998) relies on a sliding handle member to retract and extend a multiplicity of bristles into and out of an array of openings. The bristles slide and bear against the walls of the openings which creates sliding friction. Any mis-shaped bristle or debris would increase the sliding friction, and perhaps jam a bristle. The bristles in their fully retracted state will still remain somewhat exposed, which increases the opportunity to damage the ends of the bristles. The brush is not equipped with an integral cover member. This results in a potential to collect debris, which would create additional friction when trying to retract and extend the multiplicity of bristles. Also, the brush under normal daily usage, will subject the bristles to repeated bending. After usage, the bristles might take on a permanent set which would interfere with the sliding feature, increasing the friction and hindering the folding and unfolding operation of the brush. Heneveld's design is therefore unacceptable for any extended use.

U.S. Pat. No. 5,335,390 to Chen (Aug. 9, 1994) and U.S. Pat. No. 5,185,902 to Fong (Feb. 16, 1993) disclose a multiplicity of bristles which are attached to a flexible membrane. The bristles are stowed by pushing on the flexible membrane which takes advantage of the reversible nature of the membrane position to collapse the bristles into a stowed position. This still results in a fairly thick brush, making back-pocket storage rather uncomfortable, as evidenced by the fact that they still have not yet replaced a pocket comb in popularity for trouser pocket storage.

U.S. Pat. No. 4,987,633 to Heneveld (Jan. 29, 1991) utilizes a handle to retract a plurality of bristles into a base cavity. However, Heneveld's bristles do not fold over, which results in a very thick brush unsuitable for back-pocket storage.

U.S. Pat. No. 4,847,937 to Gorski (Jul. 18, 1989) relies on a sliding and rotating action to extend and collapse a multiplicity of bristles. According to Gorski's design, the user must use a hand to collapse the bristles into a stowed position. The bristles are affixed to an arcuately shaped bristle bar. The arcuately shaped bristle bar will tend to be rather thick making pocket storage impractical and uncomfortable. Like many of its predecessors, it is not equipped with an integral cover, which results in the potential to damage the bristles.

U.S. Pat. No. 4,507,818 to Perdiz (Apr. 2, 1985), discloses two embodiments. Both of these embodiments utilize a shifting plate, and a shifting projection to articulate a plurality of bristles into a position of use. The shifting plate translates within grooved side margins offering the potential to collect debris and become jammed. The shifting projections are small protrusions and do not offer much mechanical advantage in articulating the biased-shaft bristles. This type of mechanism requires that the user hold the base in one hand, and slide the shifting projection with the other hand to rotate the bristles into an operational position. These brushes are excessively thick for comfortable pocket storage due to the stack-up height of the handle, which slides underneath the bristle supporting plates, the bristle supporting plates themselves, and the removable cover. According to Perdiz's first embodiment, the combined width of the brush body, the length of the bristle in the outside row while in the stowed position, and the cover, results in a very wide brush, which is also impractical for pocket storage. Perdiz's second embodiment discloses a brush where the bristles fold in a longitudinal direction. The second embodiment, however, still presents an excessive overall height of the brush, making pocket storage impractical. A separate cover is required for both embodiments.

U.S. Pat. No. 4,498,211 to Bottolfson (Feb. 12, 1985) discloses another sliding and retracting bristle brush. A plurality of bristles retract into and out of small apertures. The sliding action urges the bristles to bear against the aperture walls during operation, which creates the same sliding friction problems as discussed above with regard to Heneveld's '877 patent. The bristles are urged through the aperture into the position of use. If the apertures become clogged, or a bristle is bent in any way, the operation will become unacceptably difficult.

U.S. Pat. No. 4,494,269 to Makabe (Jan. 22, 1985) also relies on a sliding and bearing action to fold a plurality of bristles into a stowed and operational position. A plurality of bristle bars and a movable flat board translate longitudinally, forcing the bristles against a plurality of guide-hole walls. This results in a bearing action which in turn rotates the bristles from the stowed position to the operational position, and back again. The bearing and sliding actions would tend to accelerate the wearing of individual components. Any debris will hinder the smooth operation and tend to jam the sliding and bearing components. As hair becomes entangled in the bristles, it would tend to lift the bristle bars, possibly unseating them from the movable flat board. The brush also requires a separate cover member.

U.S. Pat. No. 4,321,723 to Kortick (Mar. 30, 1982) discloses a travel hairbrush having a plurality of bristle bars, with each bristle bar having an upper and lower pivot point A plurality of bristles articulates using a sliding motion of a slotted side bar member which is affixed to a thumb tab. Sliding the thumb tab forward engages the side-bar slot walls with the upper pins, which results in the rotation of the bristle bar about the lower fixed pivot point. One of the problems with this approach is the resulting overall thickness of the brush assembly. It is too cumbersome to carry this style brush comfortably in the back pocket of trouser pants. To obtain the amount of bristle rotation required, the slots in the side bar member tend to be rather long, which directly increases the overall brush thickness. There is also the potential to collect debris in the side-bar slots which would make the brush difficult to operate. Actuating the side bar from only one side of the brush would tend to bind during operation. The second embodiment, where the slide button is on top, adds to the overall thickness, making back pocket storage impractical.

U.S. Pat. No. 4,214,340 to Youngberg (Jul. 29, 1980) is similar to Heneveld's '633 patent, above, in that a plurality of bristles are retracted, full length, into a base member. The bristles do not fold when stowed, which results in a very thick brush assembly.

U.S. Pat. No. 4,137,596 to Carlson (Feb. 6, 1979) operates similarly Heneveld, Bottolfson, and Makabe, above. A plurality of bristles bear against an array of sloped apertures during a sliding action which forces the bristles into an operational or stowed position. This type of sliding mechanism is inefficient, and prone to malfunction due to sliding friction, bent bristles and clogged apertures. Although numerous versions of this type of mechanism have been patented, none have gained any popularity as evidenced by their absence in the grooming industry.

U.S. Pat. No. 4,121,314 to Nathe (Oct. 24, 1978) discloses a collapsible brush with a plurality of bristle members, wherein each bristle member utilizes a cam feature in combination with sliding friction to rotate the bristles. The disadvantage with this approach is the sensitivity of the cam adjustment to the sliding plate. Any amount of misadjustment will adversely affect the operation of the brush. A separate cover is also required here.

U.S. Pat. No. 4,028,768 to Pascal (Jun. 14, 1977) discloses a brush in which a multiplicity of bristles are retracted through a plurality of apertures by the action of a slidable bristle bed assembly. Pushing and pulling bristles through the apertures, which is a common approach with the foldable brushes discussed herein, could jam when the bristles become slightly bent, or debris clogs any of the apertures. A separate cover would be required here as well.

U.S. Pat. No. 3,977,420 to Yalof (Aug. 31, 1976) is a single-row retractable comb. The comb utilizes a sliding rack and pinion gear mechanism to articulate a single row of tines. The rack and pinion mechanism is costly and complicated from a manufacturing, assembly, and operational sense. Any dust, dirt, lint, and hair, will tend to jam the gears. This type of mechanism would not be practical for a folding brush assembly.

As discussed above, numerous attempts have been made to build a compact folding brush, and in particular one that can be stored and carried in a trouser pocket. Each of the approaches described above is unacceptable for one or more reasons. Many prior art brushes rely on the extension and retraction of the bristles through a variety of apertures. Further, there is some sort of sliding action required for many of the brushes described above. For the reasons stated above, and for others not reported here, these prior art solutions have obviously not been well received in the grooming industry, as men and women typically do not carry the brushes described above. It would therefore be desirable to provide an improved hairbrush which can be easily carried and stored when not in use, and which is not subject to the disadvantages described above.

SUMMARY OF THE INVENTION

It is therefore one object of the present invention to avoid the disadvantages described above, and to provide a new and improved folding hairbrush.

It is another object of the present invention to provide an extremely low profile folding bristle hairbrush which can be conveniently stored in a small handbag, travel bag, or sports bag, as well as, stored comfortably in a garment that is being worn, such as a back pocket of a pair of pants.

It is yet another object of the present invention to provide a folding bristle hairbrush where the bristles are put into a position of use and non-use by the simple action of rotating a handle member.

It is yet another object of the present invention to provide a folding bristle hairbrush which can be operated with either one or two hands.

It is yet another object of the present invention to provide a folding bristle hairbrush where the handle member can function as a cover for the bristles in the stowed position.

It is yet another object of the present invention to provide a folding bristle hairbrush where the shape can be contoured, and still operate reliably and effectively.

It is yet another object of the present invention to provide a folding bristle hairbrush which can be cost effectively mass produced.

The foregoing objects are achieved as is now described. The preferred embodiment provides an improved folding hairbrush in which the action of opening and closing the brush extends and retracts the bristles through use of a lever system. This is accomplished by using a simple kinematic linkage which rotates the bristles into a position of use by merely rotating a handle member. The handle member in the preferred embodiment serves as a cover. According to the preferred embodiment, the bristles simply fold upon themselves, and do not extend or retract through an array of openings. In the preferred embodiment, spring-loaded pushbuttons, when depressed, will release a ratcheting cog which is engaged with the base, enabling the user, with one hand, to flip open, or flip close, the foldable brush, which will create a relative rotational motion between the handle and the base, as the base rotates to the either the open or closed position. This motion articulates the bristles to either a position of use or non-use depending on what direction the user is flipping the base.

The foregoing objects and advantages, as well as the characteristic features of this folding bristle hairbrush, will become more apparent with the following description and appended claims when read in conjunction with the enclosed drawings.

The above as well as additional objectives, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
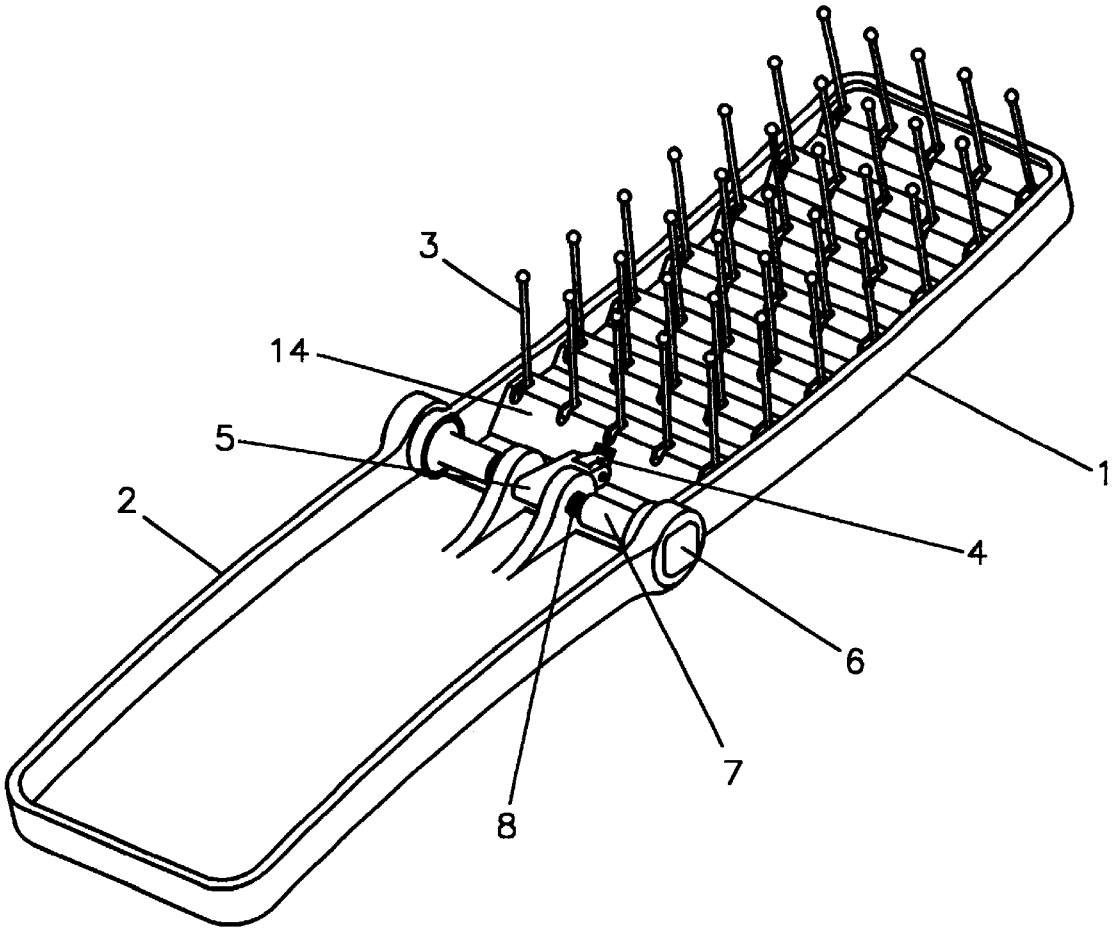
FIG. 1 depicts an isometric view in the fully opened mode in accordance with a preferred embodiment of the present invention.

With reference now to the figures, and in particular with reference to FIG. 1, the preferred embodiment, in an open position, is shown. The preferred embodiment provides an improved folding hairbrush in which the action of opening and closing the brush extends and retracts the bristles through use of a lever system. While many of the previous folding hairbrushes rely upon sliding and bearing to urge a plurality of bristles through an array of openings, the preferred embodiment operates using a simple kinematic linkage which rotates the bristles into a position of use by merely rotating a handle member. The handle member in the preferred embodiment serves as a cover. The cover reduces the possibility of debris jamming the mechanism or damaging either the bristles or the linkage while being stored in a handbag or garment pocket.

The sliding and bearing actions prevalent with the prior art, creates sliding friction, which is detrimental to the smooth operation of a foldable, collapsible, or retractable brush. According to the preferred embodiment, the bristles do not extend or retract through an array of openings, and therefore does not have to contend with sliding friction, or jamming issues experienced by the extending and retracting mechanisms.

One particularly useful feature of the preferred embodiment is the "switchblade-like" action for opening and closing the brush. In this embodiment, spring-loaded pushbuttons at the hinge, when depressed, will release a ratcheting cog which is engaged with the base, enabling the user, with one hand, to flip open, or flip closed, the foldable brush. While holding the handle stationary, the flipping action will create a relative rotational motion between the handle and the base, as the base rotates to the either the open or closed position. This motion articulates the bristles to either a position of use or non-use depending on what direction the user is flipping the base. The design of the cog, base enclosure, and spring-loaded pushbuttons of the preferred embodiment allows the brush to flip open without depressing the pushbuttons, and also prevents the brush from folding closed while using the brush. This will be accomplished with the preferred embodiment by unique ramped and stepped ratcheting teeth that are integral to the base and cog members. These teeth will disengage when depressing the pushbuttons. When the pushbuttons are released, the teeth will re-engage as a result of the urging force provided by a compression spring.

Another feature and advantage of the preferred embodiment over the prior art discussed above is the ultra-thin profile, which enables a person to carry the brush in their back pocket. In the preferred embodiment, the base and handle has a slight curvature to facilitate back-pocket storage. The kinematical linkage makes the contoured shape feasible.

A further feature and advantage of the preferred folding bristle hairbrush is the length of the handle member. The handle member is of sufficient length to offer improved mechanical advantage to articulating the bristles when compared to the slide-buttons or shifting projections in the prior art.

Figure 2:
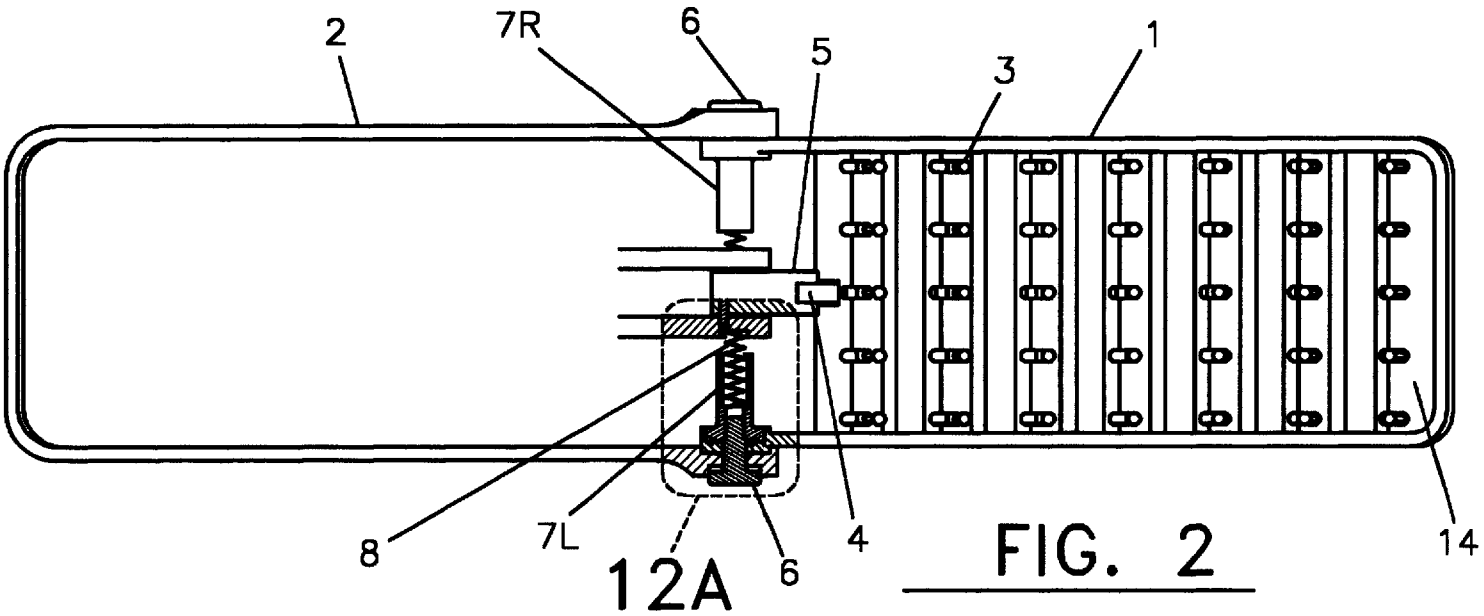
FIG. 2 is a top view of the preferred embodiment in the fully opened mode.
Figure 3:
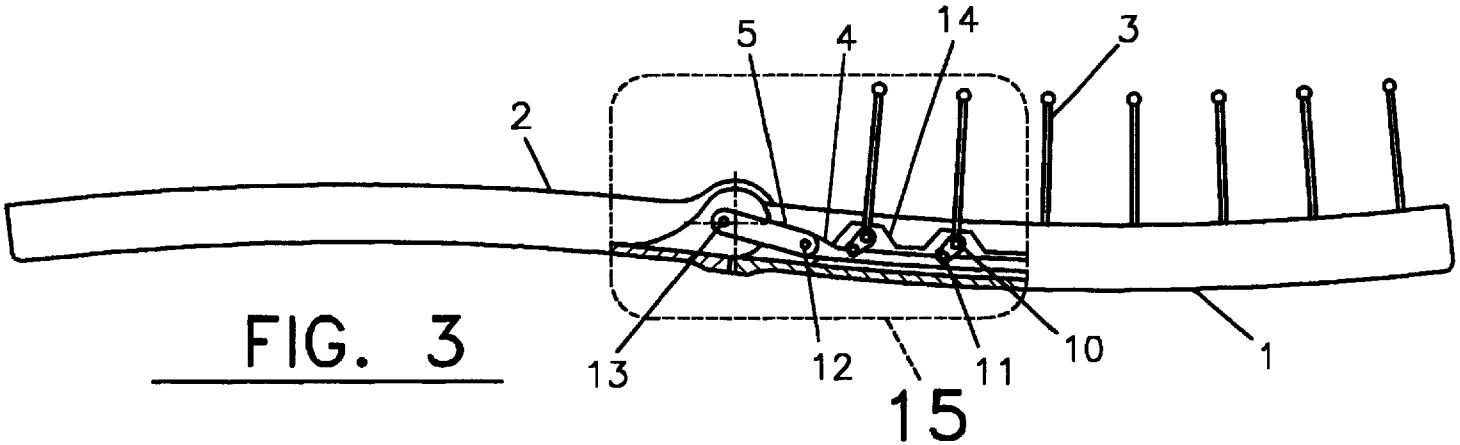
FIG. 3 is a front view of the preferred embodiment in the fully opened mode.
Figure 4:
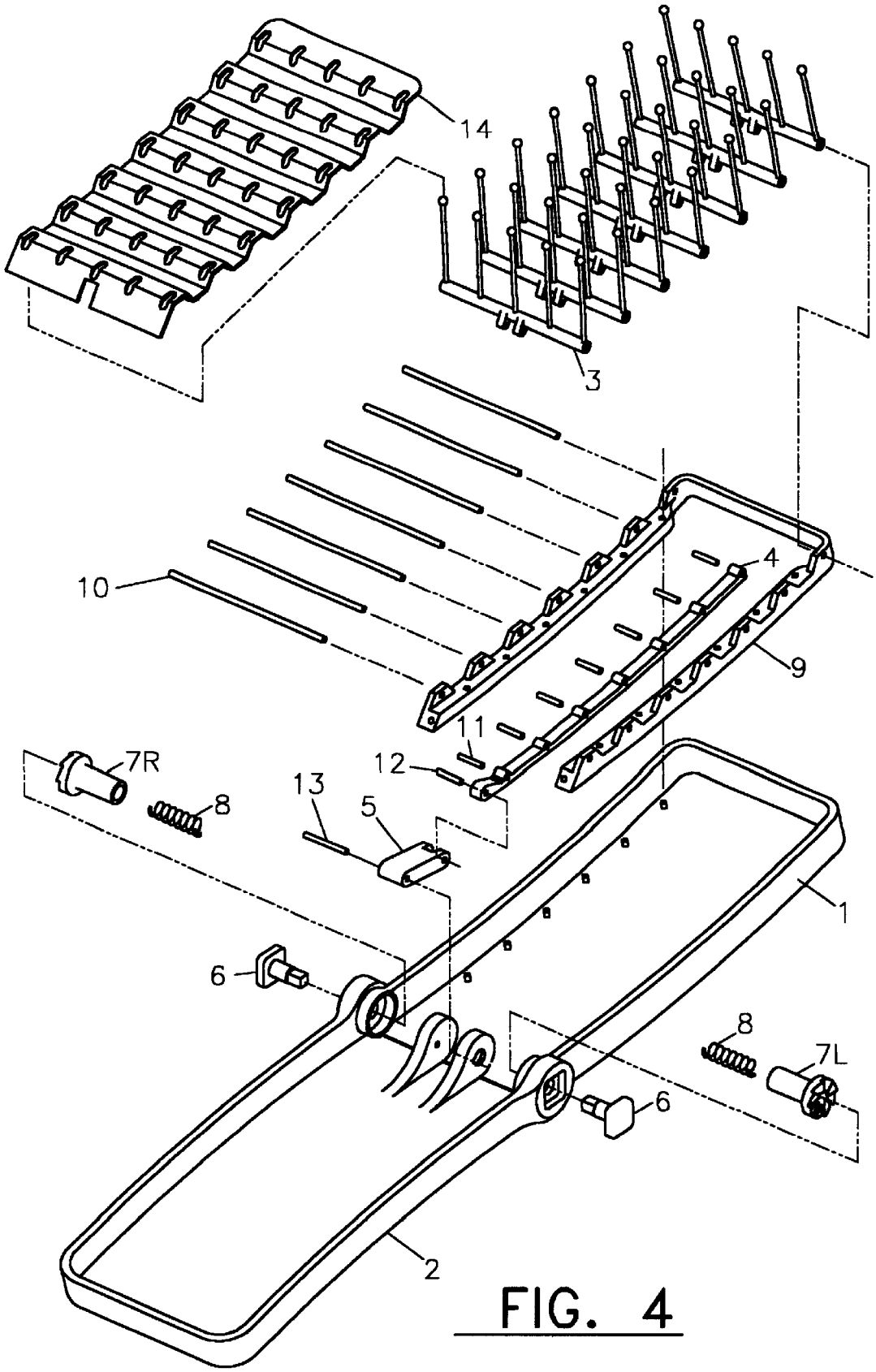
FIG. 4 is an exploded isometric view of the preferred embodiment in the fully opened mode.
Figure 8:
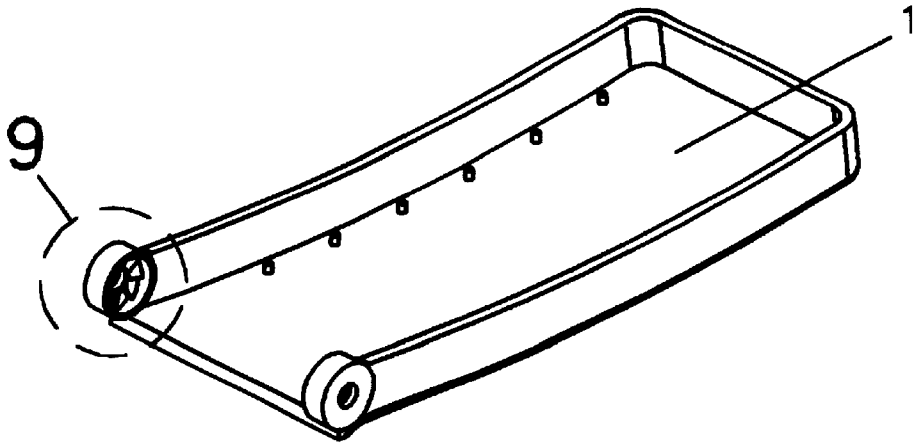
FIG. 8 is an isometric view of the base, in accordance with the preferred embodiment of the present invention.
Figure 14A:
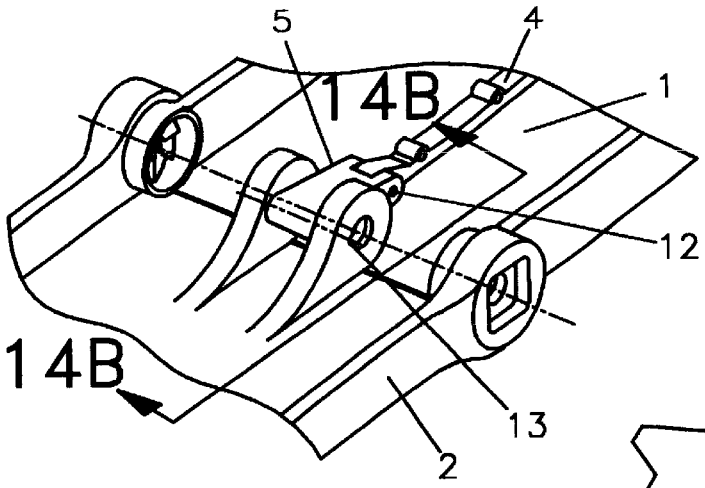
FIG. 14A is an isometric partial view of the handle link, in accordance with the preferred embodiment of the present invention.
Figure 16:
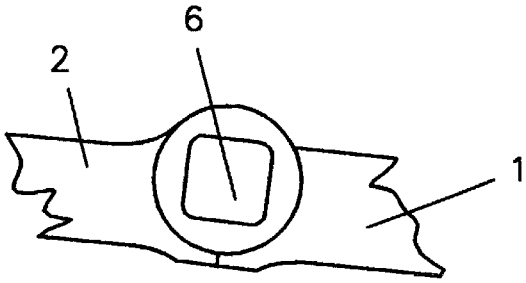
FIG. 16 is a front partial view of the stop feature, in accordance with the preferred embodiment of the present invention.

FIGS. 1 through 4 show the preferred embodiment of the folding bristle hairbrush comprising a base 1, and a lever member, hereafter referred to as handle 2. Base 1 is essentially a short-sided enclosure with one of the endwalls missing as shown in FIG. 8. The two opposing sidewalls of base 1 terminate at the open end in cylindrical protrusions which are perpendicular to the sidewalls. Handle 2, like base 1, is a short-sided enclosure with one of the endwalls missing, as shown in FIG. 4. The two opposing sidewalls of handle 2, similar to base 1, terminate at the open end in cylindrical protrusions which are perpendicular to its sidewalls. The sidewall cylindrical protrusions of handle 2 are equipped with counterbored holes on the inside surface. The counterbored holes are concentric with the cylindrical protrusions. Handle 2 is slightly wider than base 1. The base 1 sidewall cylindrical protrusions are inserted into the inside-surface counterbored holes of the handle 2 cylindrical protrusions. With the preferred embodiment, base 1 and handle 2 are made of plastic which will provide the flexibility to squeeze the cylindrical protrusions of base 1 into the inside-surface counterbored holes of handle 2, resulting in a hinged joint, as shown in FIGS. 4 and 14A. The bottom thickness of base 1 and handle 2 increases slightly out at the open ends, as shown in FIG. 16, to form bosses which become a stop when the brush is fully opened.

Figure 6:
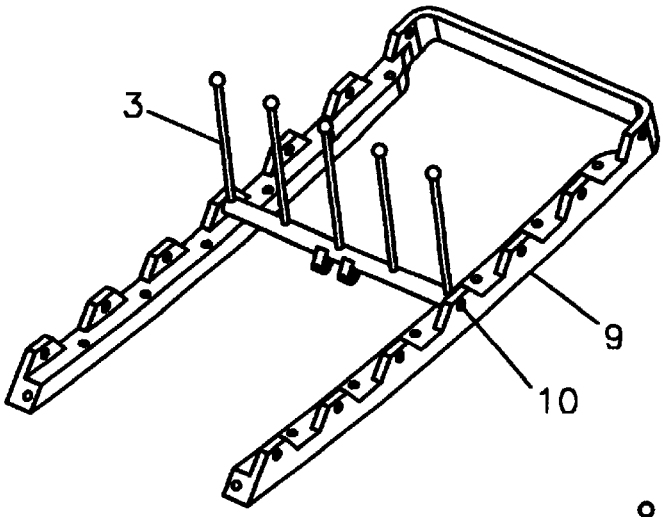
FIG. 6 is an isometric view of the bristle bar installed in the insert, in accordance with the preferred embodiment of the present invention.

An insert 9 is a three-sided u-shaped component shown in FIG. 4. The two opposing sidewalls of insert 9 contain a plurality of castellated protuberances. Each protuberance has a through-hole. A bristle bar 3, shown in FIG. 4, comprises a multiple of elongated bristle studs which are integrally attached at the base of each stud to an elongated hollow shaft. A plurality of bristle bars 3 are placed into insert 9 such that the axis of each bristle bar 3 hollow shaft aligns with the axis of each hole in each insert 9 protuberance as shown in FIG. 6. Pivot pins 10 are inserted through the holes in the insert 9 protuberances, and through the aligned hollow shafts of each bristle bar 3, thus sandwiching each bristle bar 3 between the opposing sides of insert 9, and allowing each bristle bar 3 to freely rotate about each corresponding pivot pin 10. The insert 9 sidewall holes can be slightly undersized to allow for a pressfit connection between insert 9 and pivot pin 10. The hollow shaft diameter of bristle bar 3 can be slightly oversized compared to the diameter of pivot pin 10, to allow for free rotational motion of bristle bar 3 about pivot pin 10.

An optional protective covering 14 shown in FIG. 4, which comprises an array of small openings corresponding to the number of bristle studs, is assembled to base 1 by inserting each bristle stud through its corresponding opening of protective covering 14A. The surface of protective covering 14 is a castellated series of plateaus and recesses; the number of plateaus corresponding to the quantity of bristle bars 3. The surface of protective covering 14 conforms around each bristle bar 3, and each bristle stud as shown in FIG. 3. The plateaus and recesses also conform to the castellated sidewalls of insert 9. The underside of the recessed surfaces of protective covering 14, is equipped with two rows of small integral studs; one row out toward each side as shown in FIG. 8. The insert 9 sidewall thicknesses project beyond its castellated protuberances thus forming a ledge along each sidewall. The ledges are provided with a row of through-holes; the number of holes corresponding to the number of integral studs contained on the underside surface of protective covering 14. The integral studs will be slightly oversized to allow for a pressfit connection between insert 9 and protective covering 14.

Figure 7:
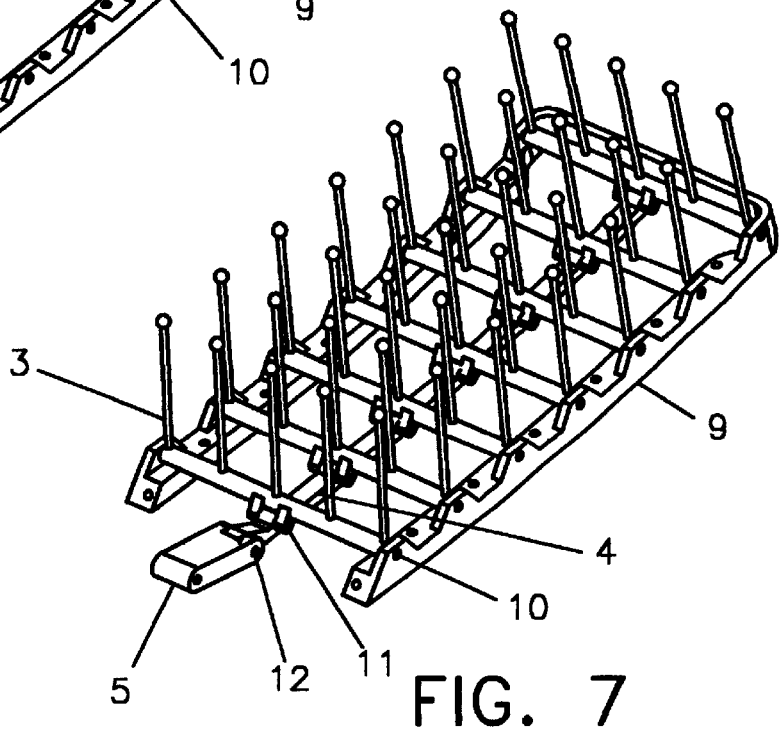
FIG. 7 is an isometric view of a subassembly comprising the insert, plurality of bristle bars, bristle link, handle link, as well as, associated pivot pins, in accordance with the preferred embodiment of the present invention.

The bristle bar's 3 hollow shafts are equipped with an integral hinge clevis centered on the lower portion of the shaft as shown in FIG. 4. An elongated bristle link 4, shown in FIG. 4, comprises a plurality of lugs on the upper surface corresponding to the quantity of bristle bars 3. Bristle link 4 is attached to each bristle bar 3 by inserting each bristle link 4 lug into each bristle bar 3 integral clevis as shown in FIG. 7. A pivot pin 11 is used to provide the hinge action between each bristle link 4 lug and bristle bar 3 clevis. The holes in each bristle bar 3 clevis can be slightly undersized compared to the diameter of pivot pin 11, to allow for a pressfit connection between the bristle bar 3 clevis and pivot pin 11. The holes in the bristle link 4 lugs can be slightly oversized compared to the diameter of pivot pin 11 to allow for free rotational movement of each bristle bar 3.

Figure 14B:
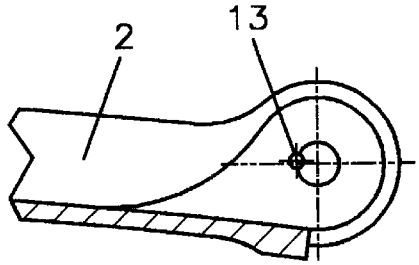
FIG. 14B is a sectioned front view of the handle clevis, in accordance with the preferred embodiment of the present invention.
Figure 15:
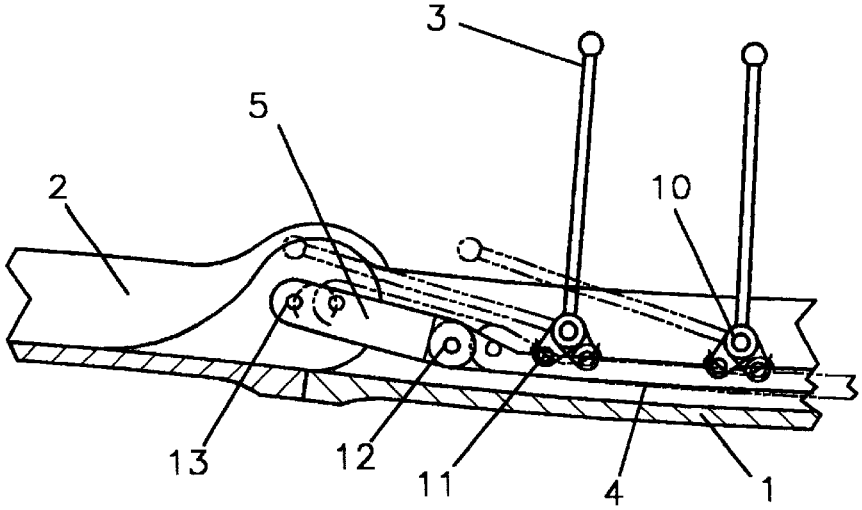
FIG. 15 is a sectioned front view close-up of the handle link, in accordance with the preferred embodiment of the present invention.

A handle link 5, shown in FIG. 4, comprises a hinge clevis feature at one end, and a lug feature at the opposite end. As shown in FIGS. 14 and 15, bristle link 4 is inserted into the clevis end of handle link 5, and pinned with pivot pin 12. Similar to the previous joints, a pressfit tolerance can be employed to secure pivot pin 12 into handle link 5, and a loose-fit tolerance can be employed to permit free rotational motion between pivot pin 12 and bristle link 4.

Figure 5:
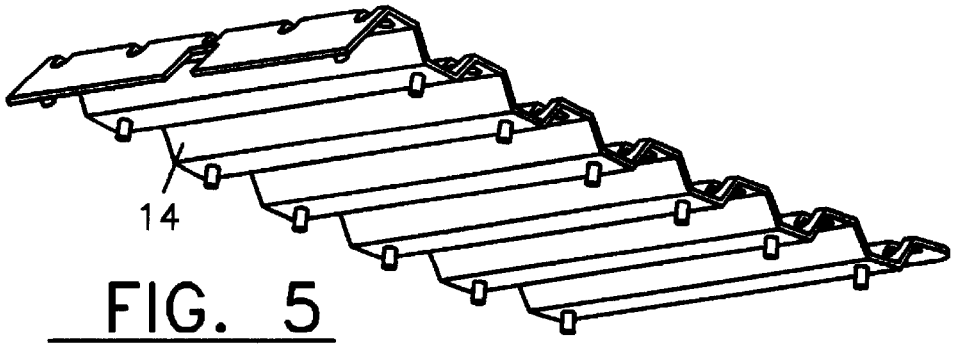
FIG. 5 is an isometric view of the underside of the protective covering of the preferred embodiment.

In the bottom of base 1, out towards the two opposing sidewalls, is a row of small integral studs, as seen in FIG. 5. Insert 9, to which is attached the plurality of bristle bars 3, bristle link 4, handle link 5, and their associated pivot pins 10,11, and 12, as shown in FIG. 7, is placed into base 1, by inserting the base 1 studs into the corresponding insert 9 ledge holes. The base 1 studs may be slightly oversized to employ a pressfit connection between base 1 and insert 9. The pivot pins 10, which secure the bristle bars 3 to insert 9, will effectively be captured between the sidewalls of base 1.

At the open end of handle 2, centered between the handle 2 sidewalls, and protruding upwards from the handle bottom, is an integral clevis, shown in FIG. 14A. The outside surfaces of the handle clevis contain 2 sets of holes as shown in FIG. 14B: one set of equisized blind holes, which are coaxial with each other, as well as, coaxial with the base 1/handle 2 pivoting axis, and one set of equisized through holes which are coaxial with each other, however, whose axis is offset from the base 1/handle 2 pivot axis.

The lug end of handle link 5 is inserted into the handle 2 clevis such that the lug hole of handle link 5 aligns with the offset coaxial through-holes of the handle 2 clevis. A pivot pin 13 is inserted through the handle 2 clevis and the handle link 5 lug as shown in FIG. 14A. Similar to several of the other aforementioned hinge connections, the clevis through-holes may be slightly smaller than the pivot pin 13 diameter to employ a pressfit attachment. Conversely, the handle link 5 lug hole may be slightly larger to ensure free rotation between handle link 5 and pivot pin 13.

Figure 10:
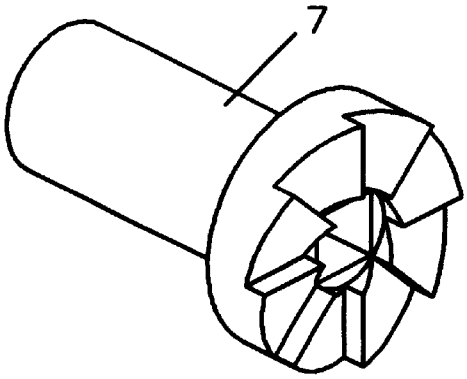
FIG. 10 is an isometric view of the cog, in accordance with the preferred embodiment of the present invention.

A cog 7, shown in FIG. 10, comprises a cylindrical head at one end, which transitions to a smaller cylindrical shaft. Cog 7 is equipped with a blind circular hole at the shaft end, and a blind square hole at the head end. An array of ramped and stepped ratcheting teeth protrude from the top surface of the cog 7 head. A left and right-hand version of cog 7, cog 7L and cog 7R, will be utilized, where the ratcheting direction for cog 7L is opposite to that of cog 7R, as these will be installed into the base opposite to each other as shown in FIG. 2. A simpler version of cog 7, shown in FIG.

Figure 12A:
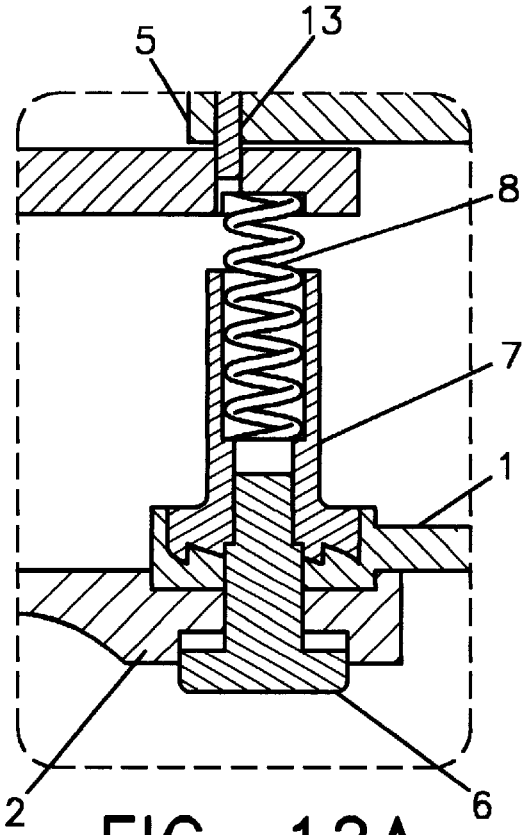
FIG. 12A is a close-up sectioned top view of the base and handle pivot joint, with the cog engaged with the base, in accordance with the preferred embodiment of the present invention.

21, which does not utilize ramped ratchet teeth would also work effectively to maintain the brush in an open mode, however, would require disengagement from similar mating teeth in base 1. The preferred embodiment discussed herein will utilize the ramped and stepped ratcheting teeth with cog 7L and 7R, however, these will hereafter be referred to as simply cog 7. A compression spring 8 is placed into the blind circular hole in cog 7. The length of compression spring 8 extends slightly beyond the end of the cog 7 shaft, as shown in FIG. 12A.

Figure 9:
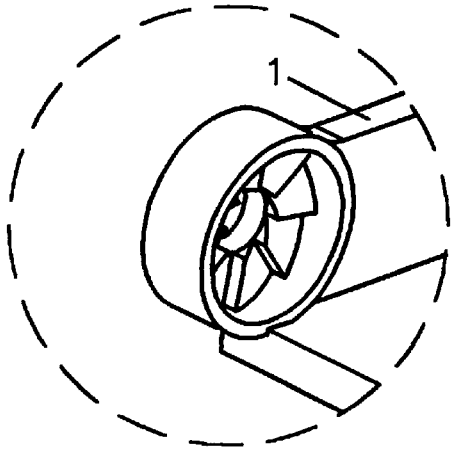
FIG. 9 is an isometric close-up view of the integral ratcheting teeth in the base sidewalls, in accordance with the preferred embodiment of the present invention.

The base 1 sidewall cylindrical protrusions contain a counterbored circular hole on each inside surface as shown in FIG. 8. At the bottom of these holes, as shown in FIG. 9, are an array of ratcheting teeth which mate with the ramped and stepped ratcheting teeth in cog 7. Cog 7, containing compression spring 8, is inserted into the counterbored cylindrical-protruded end of base 1, such that the teeth of cog 7 and the teeth of base 1 engage, as shown in FIG. 12A. Compression spring 8 will be positioned such that the exposed end is placed into the blind hole contained in the outside surface of the handle 2 clevis, as shown in FIG. 12A.

Figure 11:
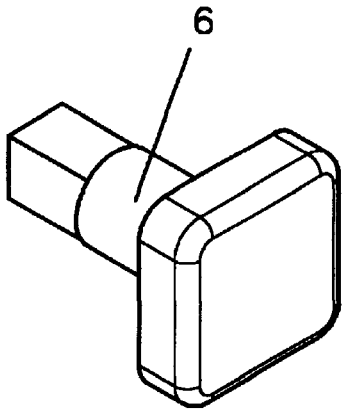
FIG. 11 is an isometric view of the pushbutton, in accordance with the preferred embodiment of the present invention.
Figure 13:
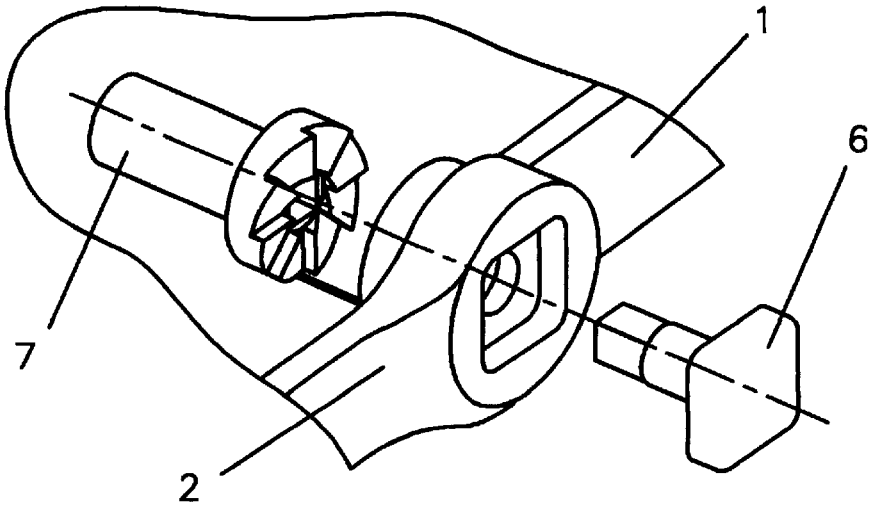
FIG. 13 is an exploded isometric partial view of the base and handle pivot joint, in accordance with the preferred embodiment of the present invention.

A pushbutton 6, shown in FIG. 11, comprises a square head which transitions into a smaller cylindrical shaft, which transitions further into a square shaft out towards the end. The outside surface of the handle 2 sidewall cylindrical protrusions are equipped with counterbored square holes, and smaller coaxial circular through-holes as seen in FIG. 14A. Pushbutton 6 is inserted into the counterbored square holes of the cylindrical protruded ends of handle 2. Pushbutton 6 is assembled through handle 2 and base 1, and into the square hole in cog 7 as shown in FIGS. 12A and 13. The pushbutton 6/cog 7 assembly may employ one of several fastening alternatives to remain attached such as a pressfit, mechanical fastener, or adhesive.

Figure 17:
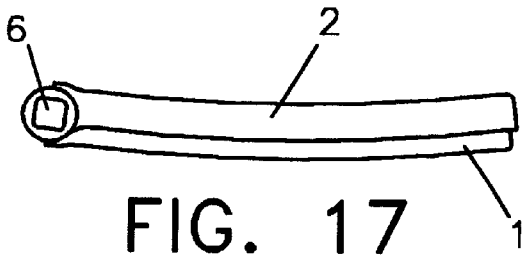
FIG. 17 is a front view of the brush in a fully closed mode, in accordance with the preferred embodiment of the present invention.

For ergonomic considerations, the shape of base 1, handle 2, bristle link 4, insert 9, and protective covering 14, in the preferred embodiment, will be slightly curved, as shown in FIG. 17.

Figure 23:
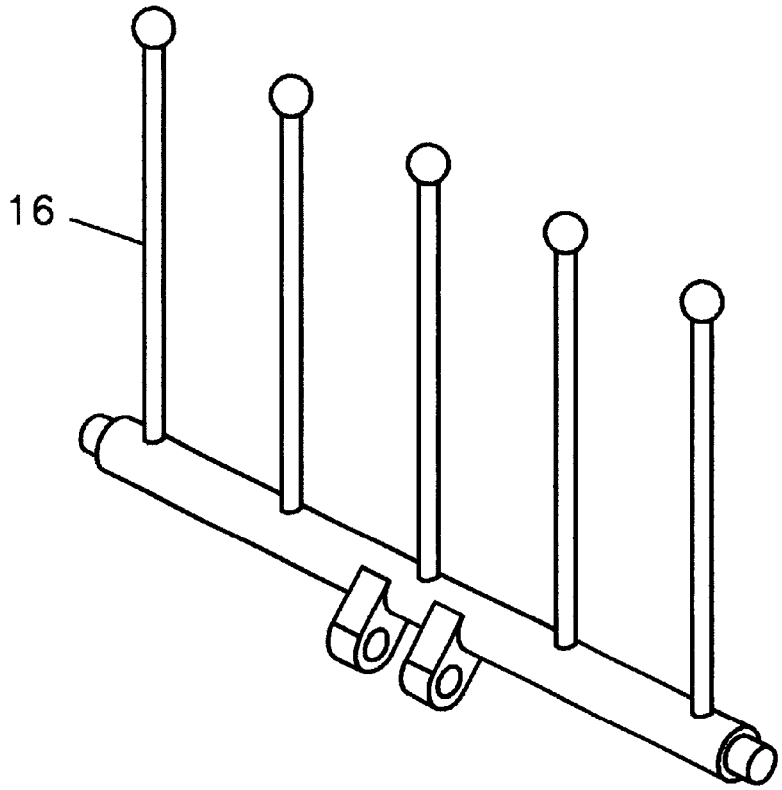
FIG. 23 is an isometric view of the bristle bar, in accordance with the simplified embodiment of the present invention.
Figure 24:
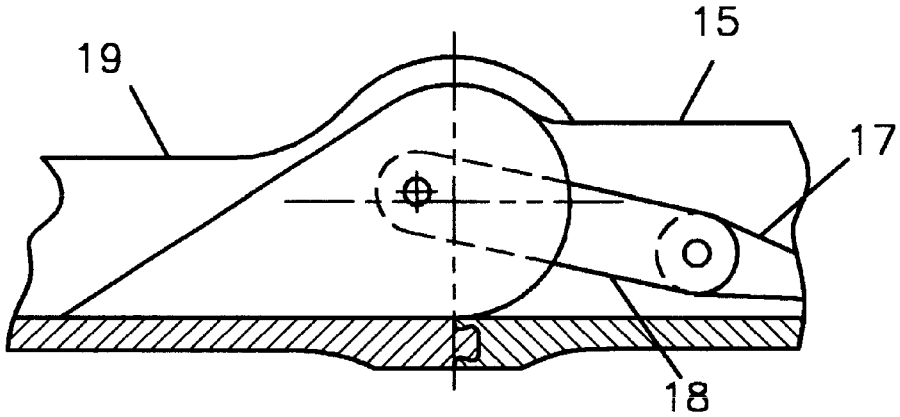
FIG. 24 is a front view close up of the latching feature, in accordance with the simplified embodiment of the present invention.

There are simpler, alternate embodiments of the disclosed hairbrush which do not require many of the components described above, yet perform the essential kinematic and articulating functions of the preferred embodiment. One such embodiment is presented in FIG. 22. This simplified version comprises a base 15, a plurality of bristle bars 16, a bristle link 17, a handle link 18, and a handle 19. Similar to base 1, base 15 is a short-sided enclosure. Along the two opposing longitudinal sidewalls are rows of small holes. Bristle bar 16 is similar to bristle bar 3 described in the preferred embodiment, with the exception that the integral main shaft is solid instead of hollow, terminating in a stepped-down diameter at each end as shown in FIG. 23. The simplified embodiment is made of plastic to enable the stepped-down diameter ends of bristle bars 16 to be inserted into the corresponding holes in the sidewalls of base 15, providing a hinged connection. Bristle link 17 is hingedly attached to each bristle bar 16, similar to the way bristle link 4 is attached to the plurality of bristle bars 3 in the preferred embodiment. Base 15 is hingedly attached to handle 19, similar to the base 1/handle 2 joint of the preferred embodiment, but without cogs, pushbuttons, or compression springs. Handle link 18 is hingedly attached to handle 19 similar to the handle link 5/handle 2 pivot joint of the preferred embodiment. A latching feature shown in FIG. 24 is used to secure the brush in the open mode with the bristles in their upright and usable position.

As can easily be seen, when using plastic parts, the pivot pins used in the preferred embodiment are not required in the simplified embodiments. The hinged joints merely require that the mating parts be equipped with small protrusions, and corresponding small recesses.

In summary, the following parts of the preferred embodiment are not essential elements: pushbutton 6, cog 7, compression spring 8, insert 9, pivoting pins 10, 11, 12, and 13, and protective covering 14. While they perform useful and desirable functions in the preferred embodiment, they are omitted in the simplified embodiment.

Figure 18:
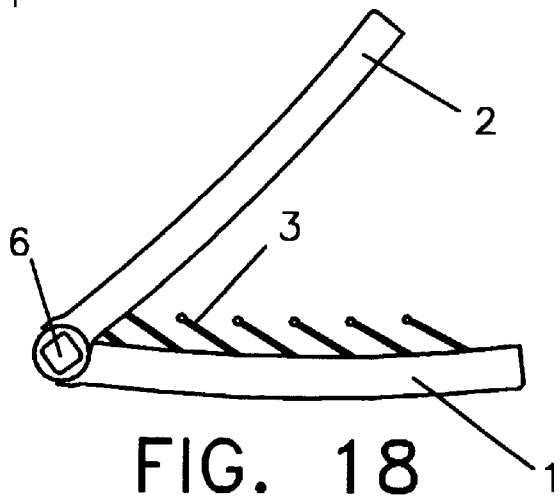
FIG. 18 is a front view of the brush in a partially opened mode, in accordance with the preferred embodiment of the present invention.
Figure 19:
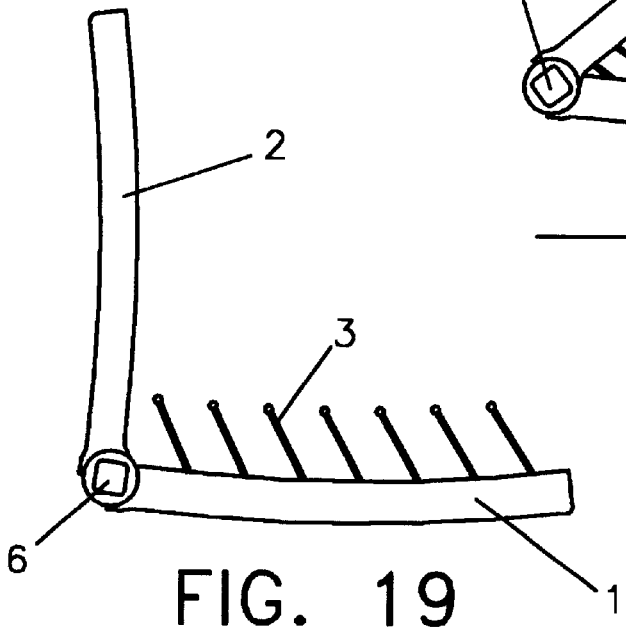
FIG. 19 is a front view of the brush in a partially opened mode, in accordance with the preferred embodiment of the present invention.
Figure 20:
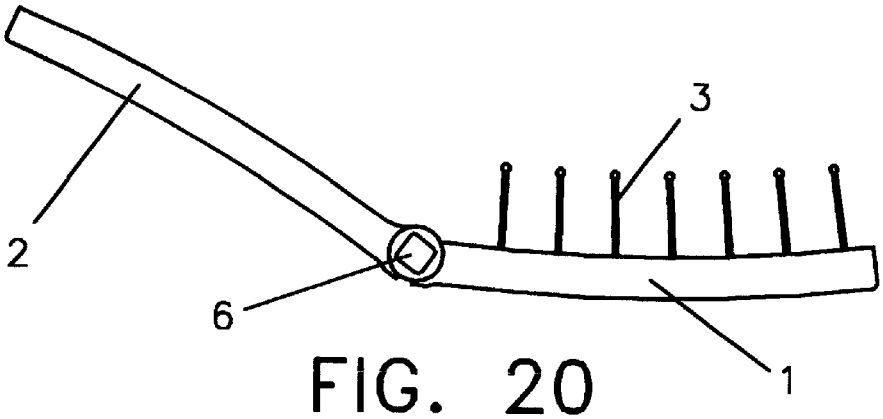
FIG. 20 is a front view of the brush in a partially opened mode, in accordance with the preferred embodiment of the present invention.
Figure 21:
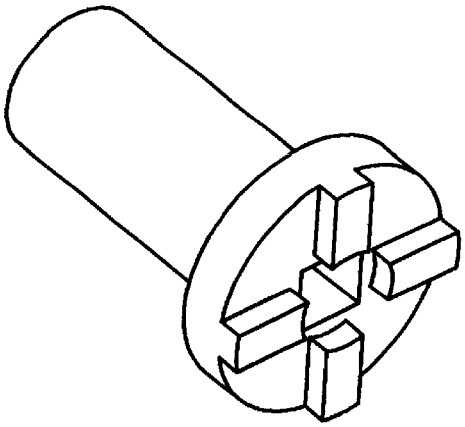
FIG. 21 is an isometric view of an alternative cog.

The operation of the preferred embodiment will now be described. To open the hairbrush, according to the preferred embodiment, and starting from a fully-closed position shown in FIG. 17, a simple clamshell-opening action of base 1 and handle 2 of the preferred embodiment, shown in FIGS. 18–20, provides the force necessary to articulate the plurality of bristle bars 3 into their position of use, shown in FIG. 3. When base 1 is rotationally separated from handle 2, pivot pin 13 rotates about the common axis shared by base 1 and handle 2, as shown in FIGS. 14B and 15. The opening rotational action of pivot pin 13 about the base 1/handle 2 common axis results in handle 2 applying a pulling force on handle link 5 through pivot pin 13. Handle link 5, in turn, applies a pulling force on bristle link 4. The motion of bristle link 4 applies a torque to each bristle bar 3 causing the plurality of bristle bars 3 to rotate from their stowed position, to their position of use. The radial position of pivot pin 13 in the handle 2 clevis, relative to the base 1/handle 2 common axis has been predetermined so that the rotation of pivot pin 13 about the base 1/handle 2 common axis defines the amount of translation experienced by connected handle link 5 and bristle link 4, which in turn, directly establishes the amount of rotation experienced by bristle bars 3.

As the base 1 and cog 7 ratchet teeth are ramped and stepped, as shown in FIGS. 9 and 10, the opening rotating action without depressing pushbutton 6, causes the cog 7 teeth to slide along the mating ramped base 1 teeth producing a translational force driving cog 7, and attached pushbutton 6, inwards. The square head of pushbutton 6, which is inserted into the corresponding counterbored square hole in handle 2, shown in FIG. 13, prevents pushbutton 6 from rotating while the cog 7 and base 1 teeth are sliding against each other. The shaft end of pushbutton 6 is also square, and as such, keyed to cog 7. Keying cog 7 to pushbutton 6, prevents the rotation of cog 7, during the opening action. Compression spring 8, which is inserted into the end of cog 7, and bearing against the handle 2 clevis, as shown in FIG. 12A, applies an axial force continually urging the cog 7 and base 1 teeth to remain engaged during all operations. Thus, without depressing pushbutton 6, the unique ramped and stepped ratchet teeth, in combination with the keying features of the pushbutton 6, handle 2 and cog 7, will permit relative motion between the base 1 and handle 2 during the opening action, and also prevent the brush from closing, as the mating teeth lock against one another while the pushbutton 6 remains undepressed.

As described in the opening action above, there is no need to depress pushbutton 6 to open the folding bristle hairbrush, however, if the user prefers, pushbutton 6 may be depressed to disengage the base 1 and cog 7 teeth for the opening action, as this would eliminate the sliding friction of the meshed ratchet teeth, which may or may not be preferred. Pushbutton 6 would, however, need to be un-depressed to re-engage the ratchet teeth to maintain the brush in its open mode.

As can be easily seen, opening the hairbrush of the preferred embodiment can be accomplished by using only one hand. With a "switchblade" like action, grasping handle 2 firmly in one hand, base 1 can be rotationally flipped out and away from the user, with or without depressing push-button 6. The flipping action generates a centrifugal force acting on the base 1, which provides the impetus to cause the base 1 to rotationally separate from handle 2. Rotationally separating base 1 and handle 2 creates a synchronized articulation of the bristle bars 3 into their upright and usable position using the dynamics associated with the kinematic linkage connecting handle 2, handle link 5, bristle link 4, and pinned bristle bars 3.

Figure 22:
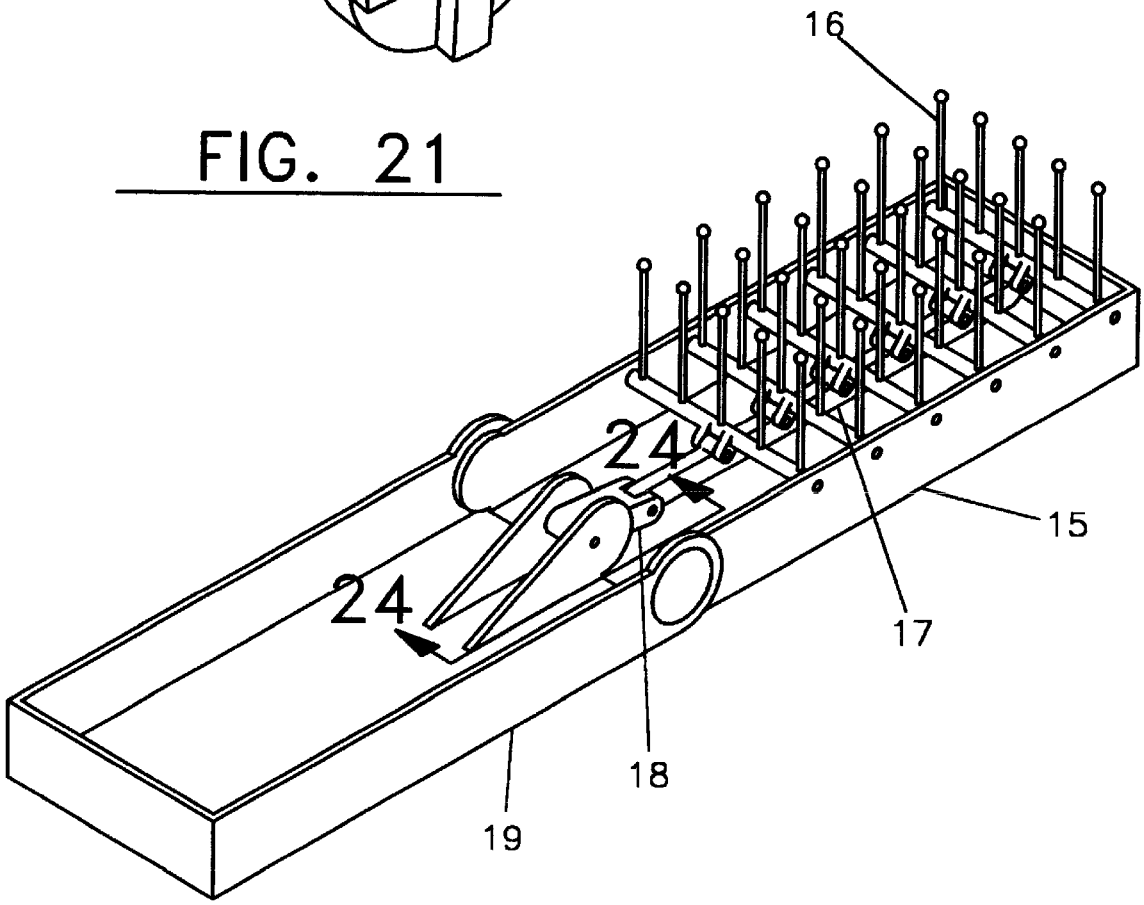
FIG. 22 is an isometric view in the fully opened mode, in accordance with a simplified embodiment of the present invention.

With the simpler embodiment shown in FIG. 22, the user merely grasps handle 19 and flips base 15 out and away using the "switch-blade" action described when opening the preferred embodiment. The action results in base 15 rotating open, and articulating the bristles into their upright and usable position. A latching feature shown in FIG. 24 will secure the brush in the open mode, and the bristles in their upright and usable position.

Figure 12B:
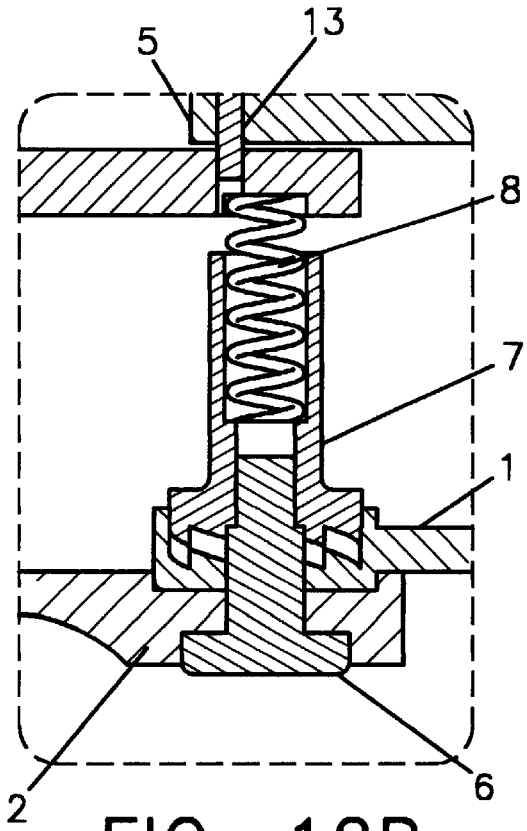
FIG. 12B is a close-up sectioned top view of the base and handle pivot joint with the cog disengaged from the base, in accordance with the preferred embodiment of the present invention.

According to the preferred embodiment, closing the brush is simply a matter of grasping the handle with one hand, and with the same hand, depress pushbuttons 6, thus disengaging the mating ratcheting teeth of cog 7 and base 1 as shown in FIG. 12B, and with a motion opposite from the opening "switchblade" action, either flip the base closed, or using the free hand, rotate the base to the closed position.

As seen in FIG. 12B, when push-button 6 is fully depressed, overcoming the urging force generated by compression spring 8, the cog 7 ratchet teeth will totally disengaged from the base 1 teeth, allowing the handle to freely rotate to the closed position. In the closing motion, the pivot pin 13, secured in the handle 2 clevis, and through handle link 5, will apply a pushing force on handle link 5. Handle link 5 will, in turn, apply a pushing force on bristle link 4. During the closing action, the handle link 5 and bristle link 4 pivot joint remains stable at pivot pin 12, shown in FIG. 3, due to the multiple pivot connections existing between bristle link 4 and the plurality of bristle bars 3, so that the pushing force, transferred from handle link 5, will translate bristle link 4 back to its closed position. This kinematic action articulates the bristle bars 3 into their reclined, or stowed position. In order to fully close the brush, according to the preferred embodiment, pushbutton 6 must be fully depressed during the entire closing operation.

Modifications, Variations, and Specific Advantages

While the above description contains specific descriptions of shapes and relative dimensions of the components of several embodiments, these should not be construed as limitations on the scope of the invention, but rather as exemplary specifications of a few embodiments thereof. Many other variations are possible, as will be clear to those of skill in the art. For example, in addition to the simplified embodiment shown in FIG. 22, an even simpler embodiment might not utilize a cover, that is, the lever member could be a slender handle. Further, although protective covering 14 shown in FIG. 1 has an array of openings, the protective covering is not required to install the bristles into their position of use as it is with many of the prior art examples cited above. Protective covering 14 is used to conceal a portion of the linkage assembly, as well as to keep debris out of the linkage.

Cog 7 and push-button 6 components, detailed in the preferred embodiment, are not essential elements, as there are many ways to secure the bristles in their usable position, as known to persons of ordinary skill in the art. There are numerous locking tab and latching designs utilized in the plastics industry which could be used with the disclosed folding bristle hairbrush to keep the brush open during use, and maintain the bristles in the upright and usable position, with one example shown in FIG. 24. These modifications, and others like them, are expected to fall within the scope of the invention.

The embodiments disclosed above have many specific advantages over the prior art solutions. Unlike the prior art discussed above, the preferred embodiment does not rely on any translational sliding action to install the bristles into their position of use. In the disclosed embodiments, the kinematic linkage assembly, when activated, applies a torque to the pinned bristle bars, which in turn rotates the bristles to their position of use. The fact that there are no components or features sliding in slots, or bristle shafts sliding and pushing against an aperture, makes the disclosed folding bristle hairbrush unique, simple to operate, and highly dependable.

The kinematic linkage used in the preferred embodiment also lends itself very well to one of the primary objectives of the invention—to create a thin and compact folding hairbrush, one which is thin enough to carry in a person's pants pocket. Even with a handle/cover member, the brush can still be as thin as a small wallet. With the kinematic linkage, the shape of the folding bristle hairbrush can even be contoured, for ergonomic considerations when carrying the brush in the pant's back pocket.

Although the preferred material is plastic, other materials such as metals, composites, wood, or any combination thereof could be used. If plastic is used, then the plastic could be opaque, translucent or transparent. The individual bristle tips could be coated with a wide variety of materials, such as rubber or Teflon to enhance the brushing operation, or remain uncoated.

One or multiple handle links 5 and bristle links 4 could be used. The number of bristles attached to each bristle bar 3 could vary. The brush can even function with one bristle attached to each bristle bar 3, and be somewhat comb-like in appearance.

As shown in the simplified embodiment, insert 9 of the preferred embodiment is optional, as there are other ways to hingedly attach bristle bars 4 to base 1; one such example shown in FIG. 22, is where the bristle bars 16 shaft is stepped at the ends and are inserted directly into the base 1 sidewalls.

The pivot pins shown in the preferred embodiment are optional—particularly when using plastic, as the components could be equipped with small integral cylindrical protrusions which snap into corresponding coaxial holes or recesses in the mating part to create the hinged connections.

Although the preferred embodiment is a slender and compact brush, the size is optional. This type of brush could be made larger or smaller; could be used with humans, or used to groom animals.

Shape is optional, as the brush may employ a variety of geometric shapes—it may be square, rectangular, circular, elliptical, narrower at one end, etc. The brush may be flat or contoured, as in the case of the preferred embodiment shown in FIG. 3.

Accordingly, while the invention has been particularly shown and described with reference to a preferred embodiment, it will be understood by those skilled in the art that various changes in form and detail may be made therein without departing from the spirit and scope of the invention. The scope of the invention is expected to be defined only by the allowed claims.

What is claimed is:

1. A hairbrush comprising:

a base enclosure, the base enclosure having opposing spaced sidewalls and an integral bottom surface:

a handle hingedly connected to the base enclosure sidewalls;

a plurality of spaced bristle bars, each bristle bar comprising a shaft and a plurality of bristles, the bristles attached to the shafts, the bristle bars extending between the base enclosure sidewalls, and the bristle bars being pivotally mounted within the base enclosure sidewalls;

an interconnecting means for conveying rotational energy from the handle to the bristle bars, thereby extending the bristles from within the base enclosure when the handle is extended from the base enclosure; and a protective covering which generally conforms to the base enclosure, the covering having a plurality of slotted openings corresponding to the plurality of bristles, the slotted openings being of sufficient size to permit the bristles to pass uninhibited through the slotted openings, the slots of sufficient length and width to permit free rotation of the bristle bars to and from the positions of use and non-use, an attachment means securing the covering to the base enclosure.

2. The hairbrush of claim 1, wherein rotation of the handle causes the bristles to be rotated from a position of non-use, in which the bristles are arranged in an oblique position within the handle enclosure, from a position of use, in which the bristles extend in a substantially orthogonal direction from said base enclosure.

3. The hairbrush of claim 1, wherein the interconnecting means comprises:

a handle link, a first end of the handle link hingedly connected to the handle; and a bristle link, the bristle link hingedly attached to a second end of the handle link, the bristle link having a plurality of pivot points corresponding to the plurality of bristle bars, wherein the bristle bars are hingedly attached to the plurality of pivot points, the bristle link being longitudinally aligned with the handle and the base enclosure, whereby rotational motion of the handle from the position of non-use results in a synchronized articulation of the bristle bars from a position of non-use to a position of use, and whereby rotational motion of the handle from the position of use results in the synchronized articulation of the bristle bars from the position of use to the position of non-use.

4. The hairbrush of claim 1, further comprising a latching means, interacting with the handle and base enclosure, for securing the handle in the extended position, thereby securing the bristles into the extended position.

5. The hairbrush of claim 4, wherein the latching means includes an integral recess in one end of the base enclosure, and an integral protrusion in the corresponding end of the handle, and wherein the protrusion snaps into the recess in the position of use, thereby securing the bristles and the handle into the position of use.

6. A folding bristle hairbrush as in claim 1, wherein the handle is of sufficient width to cover the base enclosure.

7. A hairbrush comprising:

a base enclosure, the base enclosure having opposing speed sidewalls and an integral bottom surface;

a handle hingedly connected to the base enclosure sidewalls;

a plurality of spaced bristle bars, each bristle bar comprising a shaft and a plurality of bristles, the bristles attached to the shafts, the bristle bars extending between the base enclosure sidewalls, and the bristle bars being pivotally mounted within the base enclosure sidewalls;

an interconnecting means for conveying rotational energy from the handle to the bristle bars, thereby extending the bristles from within the base enclosure when the handle is extended from the base enclosure; and a latching means, interacting with the handle and base enclosure, for securing the handle in the extended position, thereby securing the bristles into the extended position, wherein the latching means comprises a cog, the cog having a cylindrical head attached to a cylindrical body, the cog head equipped with a series of ratchet-like protrusions, the cog equipped with counterbored holes on each end, the sidewalls of the base enclosure terminating with cylindrical protrusions counterbored in such a fashion as to mate with the ratchet-like protrusions of the cog;

a pushbutton, the pushbutton comprising a non-circular shaped head attached to a shaft body, the shaft body transitioning from a circular cross-section at the pushbutton head, to a non-circular cross-section at the opposite end; and an urging means compressing the cog into the base enclosure.

* * * * *